US009057590B1

(12) United States Patent
Marino et al.

(10) Patent No.: US 9,057,590 B1
(45) **Date of Patent: *Jun. 16, 2015**

(54) ENHANCED RELIABILITY MINIATURE PISTON ACTUATOR FOR AN ELECTRONIC THERMAL BATTERY INITIATOR

(71) Applicant: BAE Systems Information and Electronic Systems Integration Inc., Nashua, NH (US)

(72) Inventors: Steven H. Marino, Gap, PA (US); Marathurai S. Jayakumar, Lexington, MA (US); Christopher E. Kohl, Austin, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/077,648

(22) Filed: Nov. 12, 2013

Related U.S. Application Data

(62) Division of application No. 13/082,635, filed on Apr. 8, 2011, now Pat. No. 8,607,703.

(60) Provisional application No. 61/322,471, filed on Apr. 9, 2010.

(51) Int. Cl.

| | |
|---|---|
| ***F42B 3/10*** | (2006.01) |
| ***F42B 3/103*** | (2006.01) |
| ***F42B 3/12*** | (2006.01) |

(52) U.S. Cl.
CPC .... *F42B 3/10* (2013.01); *F42B 3/12* (2013.01)

(58) Field of Classification Search
CPC ..... F42B 3/10; F42B 3/103; F42B 3/107; F42B 3/11; F42B 3/12; F42B 3/124; F42B 3/125; F42B 3/128
USPC ..... 102/202.5, 202.7, 202.8, 202.12, 102/202.14
See application file for complete search history.

(56) References Cited

U.S. PATENT DOCUMENTS

| | | | | |
|---|---|---|---|---|
| 3,541,961 | A * | 11/1970 | Larson | 102/202.6 |
| 3,618,524 | A * | 11/1971 | Berlin et al. | 102/207 |
| 3,971,320 | A * | 7/1976 | Lee | 102/202.9 |
| 4,239,005 | A * | 12/1980 | Simmons | 102/202.13 |
| 5,403,036 | A * | 4/1995 | Zakula et al. | 280/741 |
| 5,621,183 | A * | 4/1997 | Bailey | 102/202.7 |
| 5,686,691 | A * | 11/1997 | Hamilton et al. | 102/202.5 |
| 5,691,498 | A * | 11/1997 | Fogle, Jr. | 102/202.2 |
| 5,763,814 | A * | 6/1998 | Avory et al. | 102/202.7 |
| 6,164,208 | A * | 12/2000 | Hsu et al. | 102/202.5 |
| 6,220,165 | B1 * | 4/2001 | Sullivan | 102/206 |
| 6,230,624 | B1 * | 5/2001 | Chatley et al. | 102/202.7 |
| 6,272,992 | B1 * | 8/2001 | Chatley, Jr. | 102/202.5 |
| 6,305,286 | B1 * | 10/2001 | Fogle et al. | 102/202.5 |
| 6,357,355 | B1 * | 3/2002 | Fogle, Jr. | 102/202.2 |
| 6,454,306 | B1 * | 9/2002 | Cunningham et al. | 280/806 |
| 6,557,474 | B1 * | 5/2003 | Morte et al. | 102/202.1 |

(Continued)

*Primary Examiner* — Bret Hayes
*Assistant Examiner* — Derrick Morgan
(74) *Attorney, Agent, or Firm* — Daniel J. Long; Maine, Cernota & Rardin

(57) ABSTRACT

A system for a piston actuator comprising a configuration with lead styphnate charge material and Nichrome® bridgewire, wherein the device configuration provides very high reliability, including piston actuator applications; resistance of the bridgewire is carefully controlled to optimize power transfer from the firing circuit to the bridgewire and charge material.

6 Claims, 6 Drawing Sheets

PISTON ACTUATOR FERRULE AND HEADER ALIGNMENT SPACING

(56) References Cited

U.S. PATENT DOCUMENTS

| | | | | |
|---|---|---|---|---|
| 6,698,356 | B2 * | 3/2004 | Rosu | 102/202.5 |
| 7,059,312 | B2 * | 6/2006 | Olzinger et al. | 123/634 |
| 7,063,019 | B2 * | 6/2006 | Parks et al. | 102/202.9 |
| 7,210,703 | B2 * | 5/2007 | Young et al. | 280/741 |
| 7,762,189 | B2 * | 7/2010 | Ritchie et al. | 102/202.7 |
| 8,042,469 | B2 | 10/2011 | Rastegar et al. | |
| 2002/0069781 | A1 * | 6/2002 | Avetisian et al. | 102/202.7 |
| 2002/0109029 | A1 * | 8/2002 | Stevens | 242/374 |
| 2002/0178956 | A1 * | 12/2002 | Mattes et al. | 102/202.12 |
| 2004/0007123 | A1 * | 1/2004 | Ritchie et al. | 89/1.14 |
| 2004/0089988 | A1 * | 5/2004 | Scott et al. | 267/140.11 |
| 2004/0141279 | A1 * | 7/2004 | Amano et al. | 361/247 |
| 2005/0066833 | A1 * | 3/2005 | Hamilton | 102/202.5 |
| 2006/0027120 | A1 * | 2/2006 | Smith | 102/202.12 |
| 2006/0137559 | A1 * | 6/2006 | Mavrakis et al. | 102/202.12 |
| 2008/0060541 | A1 * | 3/2008 | Fujii et al. | 102/202.5 |
| 2010/0000436 | A1 * | 1/2010 | Niemeyer et al. | 102/202.7 |
| 2011/0252994 | A1 * | 10/2011 | Murray et al. | 102/215 |
| 2011/0297029 | A1 * | 12/2011 | Rastegar et al. | 102/202.1 |
| 2012/0174810 | A1 * | 7/2012 | Rastegar et al. | 102/247 |
| 2012/0210896 | A1 * | 8/2012 | Rastegar | 102/210 |
| 2012/0234193 | A1 * | 9/2012 | Tirmizi et al. | 102/202.7 |

* cited by examiner

TEST CONFIGURATION

200A TEST CROSS SECTION

200B END VIEW (HOUSING, PISTON, CHARGE MATERIAL NOT SHOWN FOR CLARITY)

DETAIL TEST CROSS SECTION
(RELATED TO FIGURE 5 CROSS SECTION)

HEADER AND FERRULE ASSEMBLY

PISTON ACTUATOR FERRULE AND HEADER ALIGNMENT SPACING

600

FLOW CHART

ENHANCED RELIABILITY MINIATURE PISTON ACTUATOR FOR AN ELECTRONIC THERMAL BATTERY INITIATOR

RELATED APPLICATIONS

This is a divisional application of U.S. application Ser. No. 13/082,635 filed Apr. 8, 2011 which claims the benefit of Provisional Application No. 61/322,471, filed Apr. 9, 2010. This application is herein incorporated by reference in its entirety for all purposes.

STATEMENT OF GOVERNMENT INTEREST

The invention was made with United States Government support under Contract No. W31P4Q-06-C-0330 awarded by the Navy. The United States Government has certain rights in this invention.

FIELD OF THE INVENTION

The invention relates to actuators and a process for making them, and more particularly, to a miniature piston actuator for munitions, aerospace, aeronautical and automotive applications.

BACKGROUND OF THE INVENTION

Miniature Piston Actuators can be used as electro-explosive devices (EEDs). Such devices have been used as part of an Electronic Thermal Battery Initiator (ETBI) to provide a mechanical output to initiate a thermal battery.

Thermal batteries are designed for immediate and short duration activation under extreme operating conditions. In an inert state suitable for storage, a thermal battery is dormant, and can remain inactive for long periods of time. Upon initiation, a thermal battery instantly activates to serve as an accurate, low-impedance, voltage source that is stable for a predetermined time duration.

Additionally, explosive and pyrotechnic devices such as explosive bolts, bolt cutters, separation fairings, actuators, engine igniters, etc., are used in aeronautical and aerospace applications to perform various functions such as the separation of one structure from another, the release of a structure from a stowed position to a deployed position, etc. They are also used in the safety systems of land vehicles such as automobiles, for the deployment of air bags. Such devices are typically coupled to electrically operated initiators which, in response to suitable electrical signals, initiate the devices.

In aeronautical and aerospace devices such as missiles, satellites, launch vehicles, etc., and in land vehicle safety systems, the initiators in the ordnance firing systems that control the various explosive or pyrotechnic effectors typically comprise a hot bridgewire initiating element and an initiating charge of explosive or pyrotechnic material which is sensitive to the initiating element. In order to stimulate the hot bridgewire initiating element to release sufficient energy to ignite the ignition charge, a large amount of electrical energy (relative to what is generally required for most other functions on such devices) is required. For example, the firing of a hot bridgewire initiator typically requires a draw of several (typically 2-3 or more) amps from a 28-volt source for a period of about 0.05 second. Since there may be numerous effectors on a given device, the total energy requirement for initiation of the effectors may exceed the energy requirement for operation of the circuitry that controls the device. For this reason, ordnance firing systems typically include a dedicated high power energy source such as a thermal or chemical battery, for the purpose of providing sufficient energy to fire the hot bridgewires. The need in aerospace and aeronautical devices to provide such batteries, which are large and heavy, has been viewed as an unavoidable but significant burden. The batteries occupy space which could go to other, more useful, components of the device or to increased payload capacity and for airborne devices. They also increase the fuel consumption of the device at all times during flight. In some applications, such as for initiation of a thermal battery of a munition after launch, this energy requirement is impractical. A miniature piston actuator (PA) with a very low firing energy requirement which can provide a mechanical output to initiate the thermal battery is thus needed.

The current generation of piston actuators (PAs) for applications utilizes potassium dinitro benzo furoxan (KDNBF) as the explosive charge material and platinum as the bridgewire. KDNBF charge material is used to maximize gas generation to provide the actuating force. These PAs have an appreciable failure rate (~5%) especially at cold temperature (−40 C), even when they were provided a firing energy greater than the all-fire energy requirement.

Current piston actuators do not provide a sufficiently high reliability within the constraints of available volume and electrical firing energy. Such devices are limited in their operation in that they suffer from poor reliability, including under exposure to extreme acceleration, limited altitude operation range, and narrow temperature operation range-especially at low operating temperatures. Additionally, they should remain safe and not be susceptible to premature detonation.

In these environments, weight and volume are at a premium, and an increase in system weight and volume presents packaging and weight management problems which may require significant engineering time to solve.

What is needed, therefore, are more reliable actuators.

SUMMARY OF THE INVENTION

Embodiments provide a device and process for making major improvements in performance, reliability, and producibility that overcome current limitations. One embodiment of the present invention provides a system for piston actuators, the system comprising a configuration with lead styphnate (LS) charge material and Nichrome® bridgewire, wherein the configuration provides very high reliability, including detonator and piston actuator applications; wherein resistance of the bridgewire is carefully controlled to optimize power transfer from the firing circuit to the bridgewire and charge material.

An embodiment provides a piston actuator device, the device comprising a header; an electrode within the header; a glass insulator within the header; a bridgewire forming a circuit between the header and the electrode, wherein resistance of the bridgewire is controlled to ensure that a minimum all-fire energy of the device is available from a firing circuit; a ferrule assembled to the header/bridgewire assembly; charge material within the ferrule adapted to be activated by a current through the bridgewire; whereby very high reliability is provided; a piston and a housing. In another embodiment, the charge material consists essentially of lead styphnate (LS), whereby flow overcomes effects of voids and fissures, fills gap between header and glass fill seal, and flows around circumference of the bridgewire increasing surface area. For further embodiments, the LS is about 30 hr mil, whereby the particle size is reduced, improving the flow. For another embodiment, the bridgewire comprises a nickel chromium alloy. In others, the bridgewire resistance is about 2 to 4 ohms, whereby power transfer to the bridgewire is optimized. For yet others, the bridgewire resistance is about 3 ohms. In another embodiment, reliability exceeds about 99.5 percent. Other embodiments have a minimum gap of about 0.001 inch between the ferrule and the housing, the gap preventing the ferrule and the charge material within from being disturbed during assembly of the housing. In a yet additional embodiment, function time comprises a minimum of about 38 microseconds; an average of about 58 microseconds; and a maximum of about 134 microseconds.

Another embodiment provides a miniature piston actuator system, the system comprising a miniature piston actuator comprising a header; an electrode within the header; a glass insulator within the header; a bridgewire forming a circuit between the header and the electrode, a ferrule assembled to the header/electrode assembly; charge material within the ferrule adapted to be activated by a current through the bridgewire; whereby very high reliability is provided; a piston; and a housing; wherein the miniature piston actuator is an electro-explosive device (EED) comprising part of an electronic thermal battery initiator (ETBI) to provide a mechanical output to initiate a thermal battery, whereby the system provides very high reliability. For further embodiments, the charge material consists essentially of lead styphnate (LS), whereby flow overcomes effects of voids and fissures, fills gap between header and glass fill seal, and flows around circumference of the bridgewire increasing surface area; and the bridgewire comprises a nickel chromium alloy. In an embodiment, there is a minimum gap of about 0.001 inch between the ferrule and the housing, the gap preventing the ferrule and the charge material within from being disturbed/cocked during assembly of the housing. For another embodiment, reliability exceeds about 99.5 percent. For others, the header and ferrule comprises gold plating.

Yet another embodiment provides a method for manufacturing a miniature piston actuator, the method comprising the steps of providing a header electrode assembly; welding a bridgewire to electrode of the header electrode assembly; installing a ferrule; applying charge material; installing a housing; and installing a piston. In one embodiment, the piston actuator comprises charge material consisting essentially of lead styphnate (LS), whereby flow overcomes effects of voids and fissures, fills gap between header and glass fill seal, and flows around circumference of the bridgewire increasing surface area; and the bridgewire comprises a nickel chromium alloy. For others, function time of the piston actuator comprises a minimum of about 38 microseconds; an average of about 58 microseconds; and a maximum of about 134 microseconds. Yet further embodiments comprise gold plating of the header of the header assembly and the ferrule. For still further embodiments, the step of milling the LS to about 30 hr mil, whereby the particle size is reduced, improving the flow. In an additional embodiment, the miniature piston actuator is an electro-explosive device (EED) comprising part of an electronic thermal battery initiator (ETBI) to provide a mechanical output to initiate a thermal battery.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
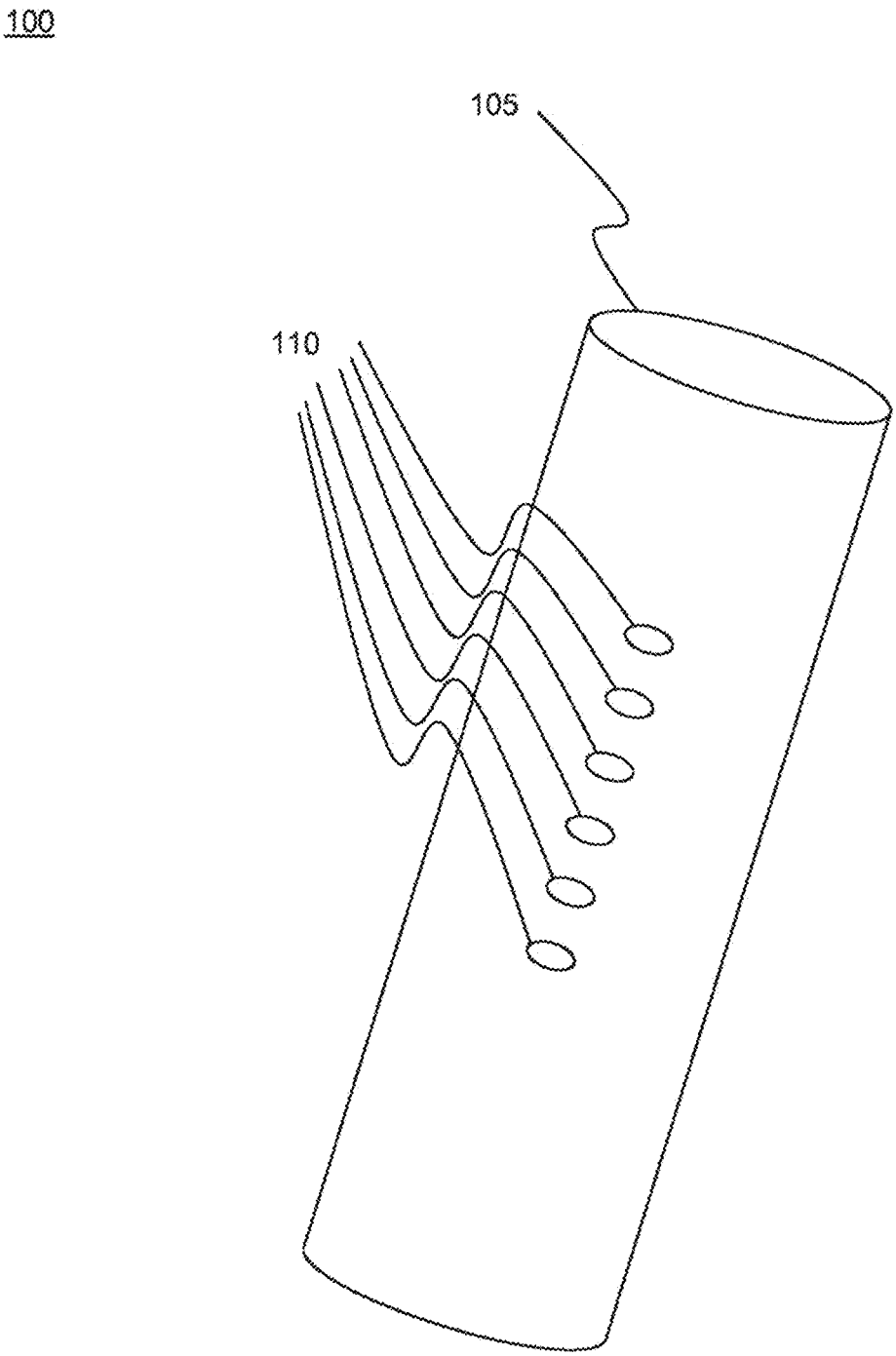
FIG. 1 is a test configuration depicting aspects of the present invention.

Safety, military, and aerospace applications demand the highest level of reliability. "One-shot" reliability is imperative in missiles, weapons, and aerospace applications where extreme conditions of shock, load, and vibration exist. Reliable operation overcomes less than adequate thermal interface between the bridgewire and the charge material. Embodiments use an electro-explosive device (EED) configuration with lead styphnate charge material and Nichrome® bridgewire. This configuration in piston actuator applications is novel. In particular, in the present embodiment, resistance of the bridgewire is carefully controlled to ensure that the minimum all-fire energy of this EED is within the capability of the firing circuit. Testing shows that it provides an improved thermal interface between the bridgewire and the charge material resulting in surprisingly improved reliability. Two hundred twenty six of these Piston Actuators were tested at different temperature conditions (cold, ambient and hot) with no failures.

Series of tests were conducted to determine the ability of embodiments to reliably perform. Test protocols comprised simulated aging, thermal shock, cold temperature (−43 C), elevated temperature (+145 F), Neyer-D tests, all fire testing, no fire testing, output force testing (high 160 lbs, low 84 lbs, mean 107 lbs. STD 20). Testing produced unexpected results for very greatly enhanced reliability, as mentioned, a sample of 226 units produced 226 successful operations (exceeding 99.55%).

FIG. 1 is a test configuration 100 in accordance with an aspect of the present invention. Body 105 is depicted with multiple PA ETBI firings 110.

Figure 2:
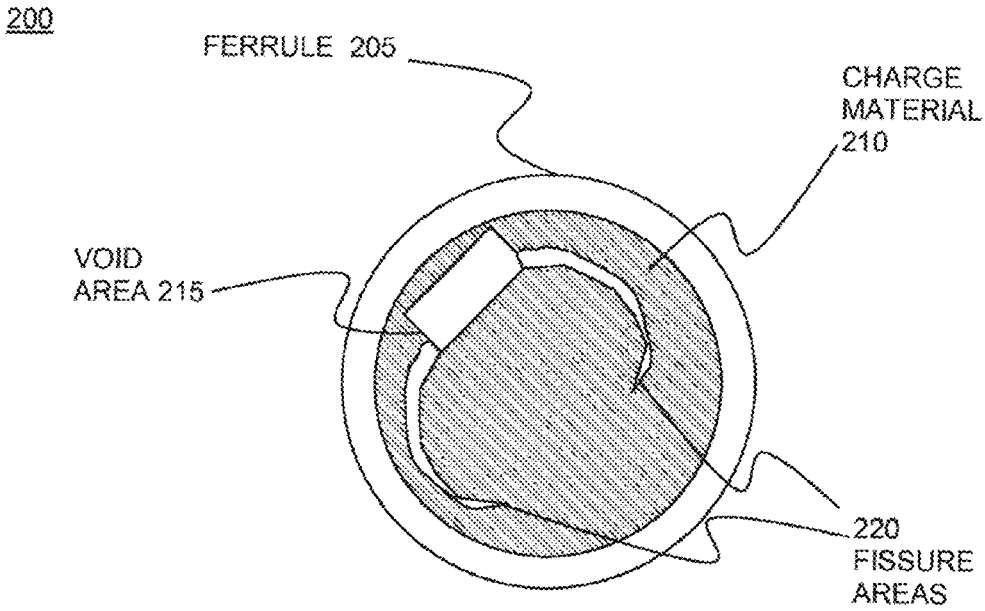
FIG. 2 is a test cross section and end view depicting aspects of a piston actuator.
Figure 2:
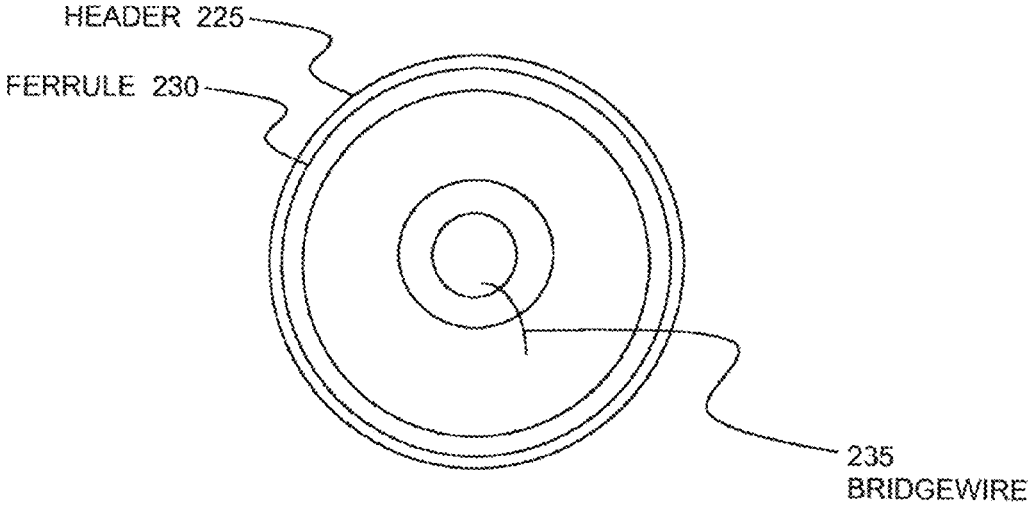

FIG. 2 is a cross section 200A and end view 20013 depicting aspects of a piston actuator. Test cross section 200A shows ferrule 205 containing charge material 210. Void 215 and fissure areas 220 illustrate failure contributors. End view 20013 (shown without housing, piston, or charge material for clarity) identifies header 225, ferrule 230, and bridgewire 235. Embodiments provide a PA manufactured with lead styphnate charge material and Nichrome® bridgewire. For embodiments, bridgewire resistance is controlled to 2-4 ohms. Units of embodiments (Nichrome® bridgewire, Lead Styphnate charge) were functioned units conditioned at −43 C; actual ETBI circuit (with coin cell) at ambient temperature used for functioning. Embodiments use Rayovac® cells, and 126 ms firing time.

Figure 3:
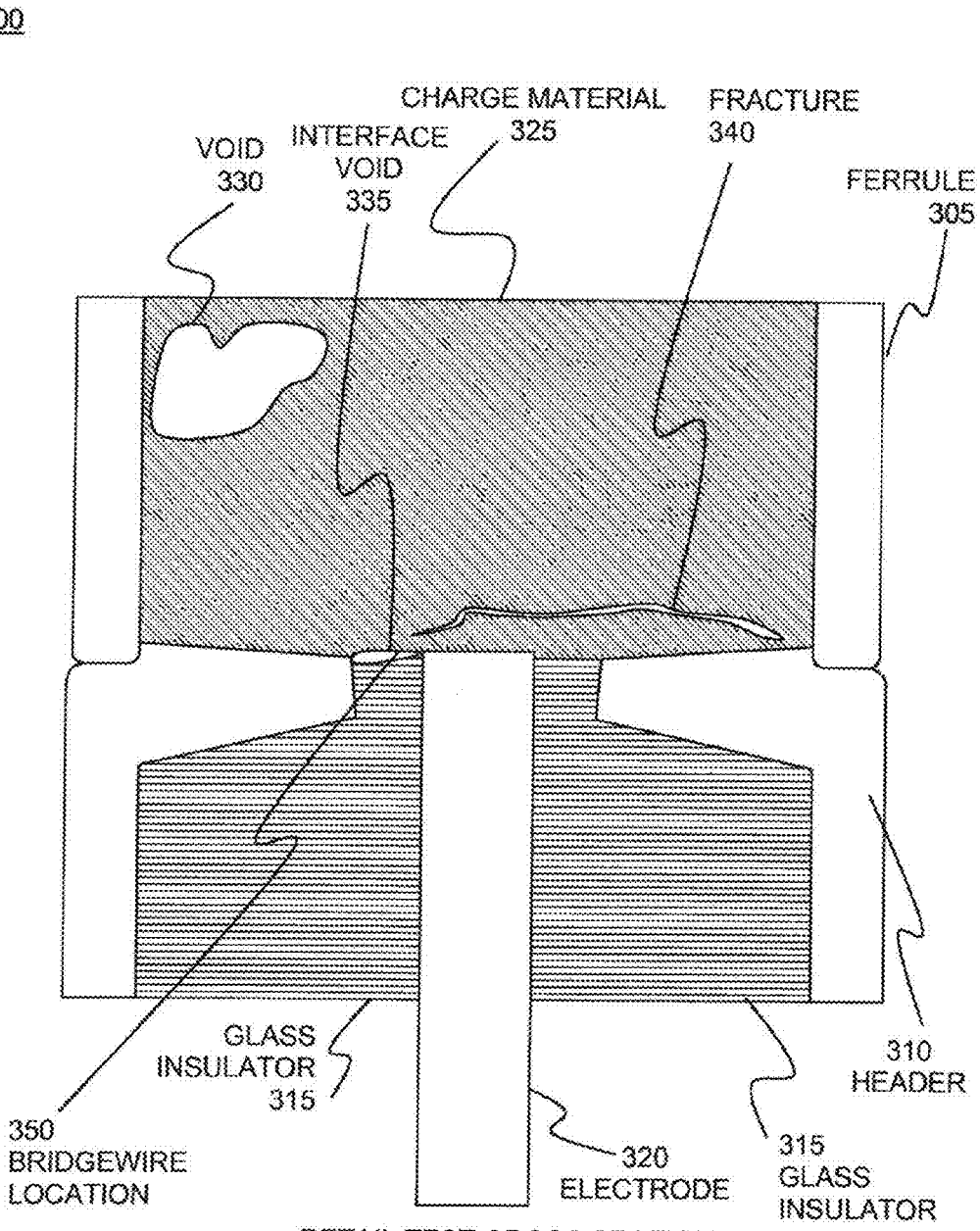
FIG. 3 is a side cross section view depicting aspects of a piston actuator.

FIG. 3 is a side cross section view 300 depicting aspects of a piston actuator. Components comprise ferrule 305, header 310, glass insulator 315, electrode 320, charge material 325, void 330, interface void 335, fracture 340, and bridgewire location 350. Observed failures involved platinum bridgewire with pressed KDNBF; they failed to initiate when provided with the firing energy and either remained intact, or fused in the middle, but without initiating the charge material.

Piston actuator embodiment configurations with NiCr Bridgewire/Lead Styphnate overcome voids around the bridgewire area as the Lead Styphnate flows between the header and the glass seal, additionally, the LS has better chance to flow around the circumference of the bridgewire, more fully encapsulating it, providing increased surface area. This induces more heat from the bridgewire to the Lead Styphnate for a greatly more reliable function.

Figure 4:
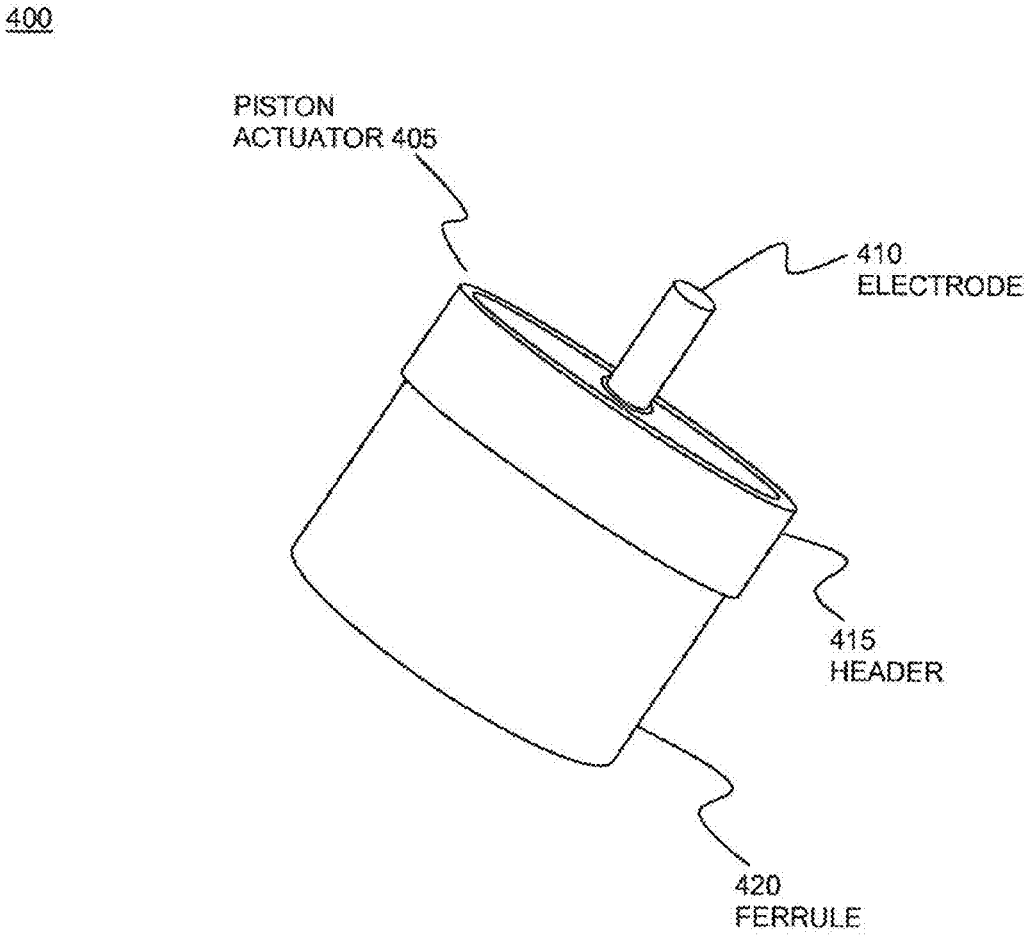
FIG. 4 is a perspective view of header and ferrule assembly configured in accordance with an embodiment of the present invention.

FIG. 4 is a perspective view 400 of header and ferrule assembly configured in accordance with an embodiment of the present invention. Piston actuator 405 comprises electrode 410, header 415, and ferrule 420.

Laser Spot Weld Schedule Parameters Table

| # | V (volts) | t (ms) | E (J) | E (J/cm$^2$) | D |
|---|---|---|---|---|---|
| 1.* | 200 | 2.4 | 1.34 | 507 | 8 |
| 2. | 190 | 2.4 | 1.14 | 539 | 2 |
| 3. | 190 | 2.0 | 0.90 | 340 | 8 |
| 4. | 190 | 1.6 | 0.66 | 310 | 2 |

Laser spot weld embodiments overcome weld blowout through the ferrule wall, minimize any cracking, and provide additional pull strength. About four welds were located around the circumference at the ferrule header interface. Laser spot welding pull-test on unwelded units exhibited a retaining force range of from 0.2 lb to 7.0 lb. Representative press fit values are ferrule ID=0.0617"-0.0622", and header diameter of 0.0625"-0.0630".

Figure 5:
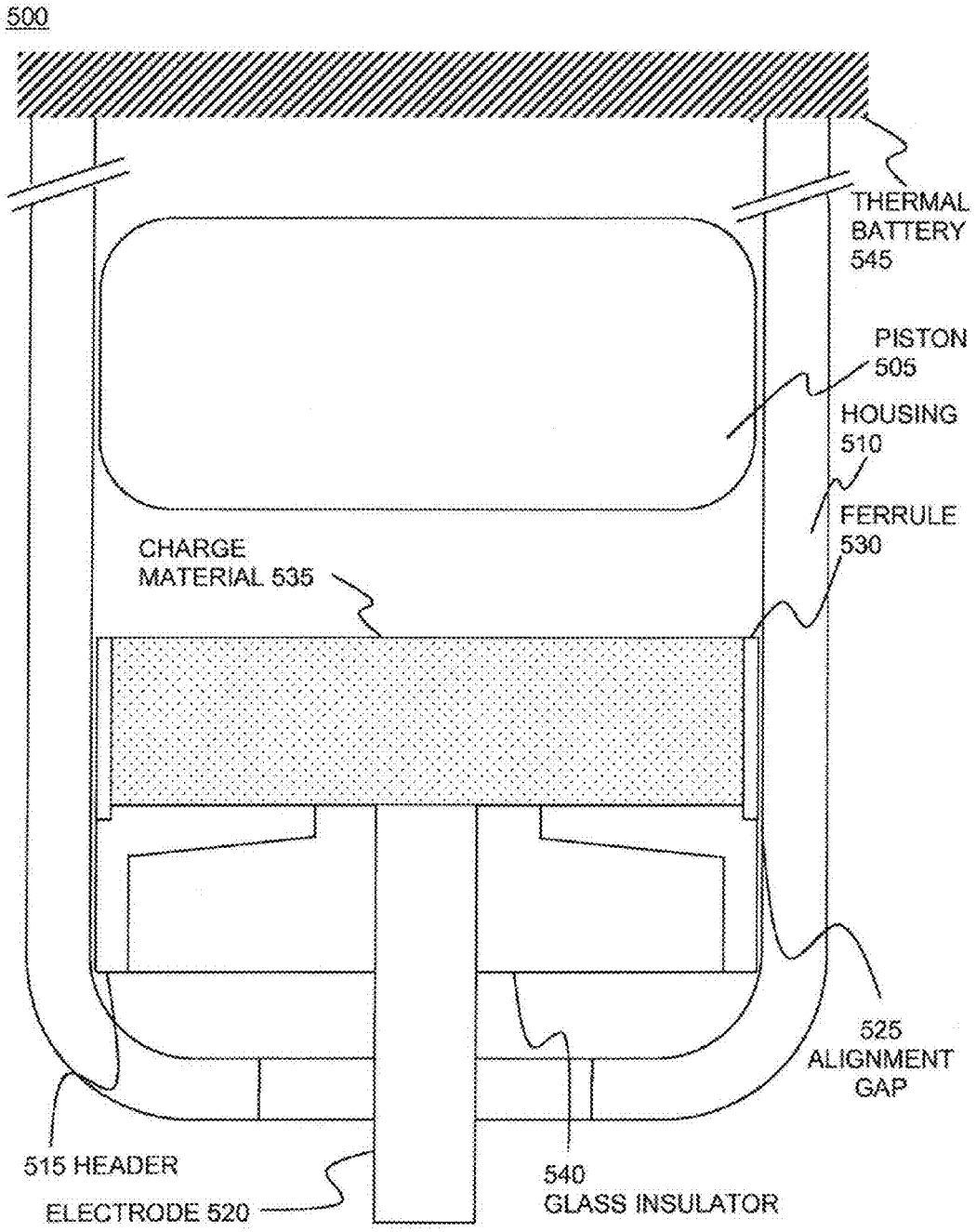
FIG. 5 is side cross section view of a piston actuator configured in accordance with an embodiment of the present invention.

FIG. 5 is side cross section view 500 of a piston actuator with piston 505, housing 510, header 515, and electrode 520. Embodiments maintain narrow gap spacing 525 to overcome misalignment and minimize likelihood of disturbing the ferrule 530 and charge material 535 during assembly of the housing. Glass insulator 540 is within header 515. Related components are depicted in FIG. 3.

Figure 6:
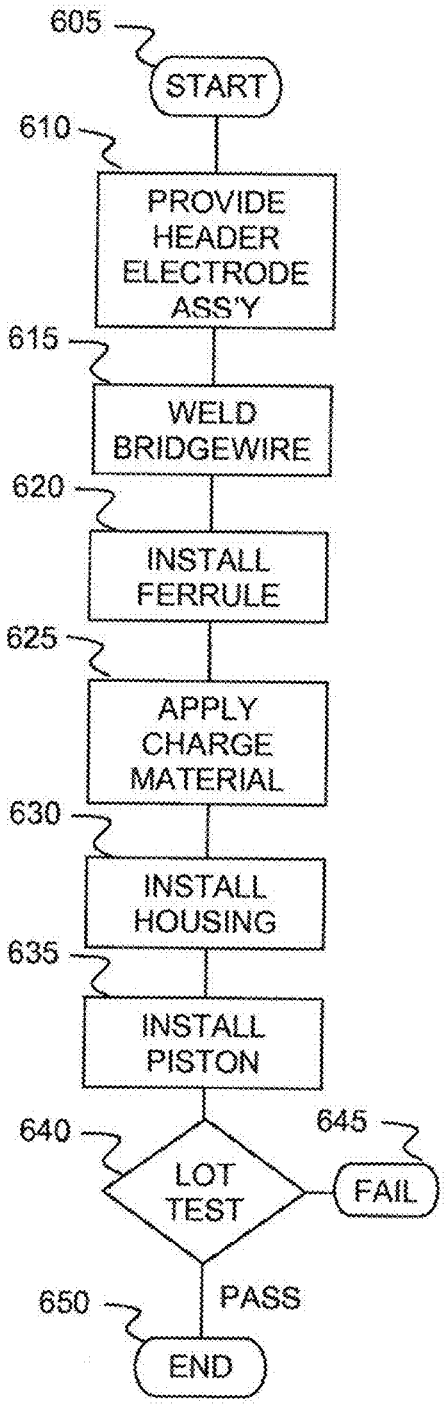
FIG. 6 is a flow chart configured in accordance with one embodiment of the present invention.

FIG. 6 is a flow chart 600 configured in accordance with one embodiment of the present invention. Method steps comprise start 605, providing header electrode assembly 610, welding bridgewire 615, installing ferrule 620, applying charge material 625, installing housing 630, installing piston 635, lot testing comprising function test and ferrule/header pull test 640, failing 645 if values not met, and ending 650 if passed.

Embodiments overcome failure modes comprising ferrule shift during assembly, charge material separation during cold soak, charge material separation during launch, charge material separation and bridgewire break during launch, and ferrule shift during launch.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

What is claimed is:

1. A method for manufacturing a miniature piston actuator, said method comprising the steps of:

providing a header electrode assembly comprising a header and an electrode, said header having a first end and a second end, said first end comprising a planar surface, said planar surface having a shoulder cut-out around perimeter of said first end, said header defining an aperture through a center portion of said header extending from said first end to said second end, said header size corresponding to an M100 designation, an outer diameter of said header being approximately 0.100 inch, and there not being more than one electrode having a first end and a second end, said first end of said electrode extending within said aperture of said header, said first end of said electrode being flush with said planar surface of said first end of said header, and there is a glass insulator within said aperture of said header, said glass insulator providing a glass fill seal between said electrode and said aperture of said header, and said glass insulator being flush with said planar surface of said first end of said header;

welding a bridgewire to the electrode of said header electrode assembly, said bridgewire forming a circuit between said header and said electrode, said header and said bridgewire comprising a header/bridgewire assembly, wherein resistance of said bridgewire is controlled to ensure that a minimum all-fire energy of said device is available from a firing circuit;

installing a ferrule, said ferrule comprising a ring having a first end and a second end, and dimensions of said second end of said ferrule corresponding to said shoulder cut of said header, said second end of said ferrule being located in said shoulder cut of said first end of said header;

applying charge material within said ferrule, said charge material being filled to be plane with said first end of said ferrule, said charge material adapted to be activated by a current through said bridgewire, and reliability of said piston actuator activation exceeding approximately 99.5 percent of said activated charge material becoming an expanding gas;

installing a piston, said piston proximate said charge material, said piston being moved to provide mechanical output by said charge material expanding gas, said piston, said header, said ferrule, and said bridgewire comprising a piston header ferrule/bridgewire assembly; and installing a discrete housing around said piston header ferrule/bridgewire assembly, said housing having a first end and a second end, said first end of said housing defining an opening having a diameter through which said second end of said single electrode extends, and said diameter of said opening of said first end of said housing being less than said diameter of said header, said housing having a cylindrical inner diameter larger than said diameter of said header, and said header, ferrule, and the piston sliding Iv fitting within said housing, and said second end of said housing open to receive said piston header ferrule/bridgewire assembly, such that said piston provides said mechanical output to initiate said electronic thermal battery by striking, said electronic thermal battery.

2. The method of claim 1 wherein said piston actuator comprises:

charge material consisting essentially of lead styphnate (LS), whereby flow overcomes effects of voids and fissures, fills gap between header and glass fill seal, and flows around circumference of said bridgewire increasing surface area; and said bridgewire comprises a nickel chromium alloy.

3. The method of claim 1 wherein function time of said piston actuator comprises:

a minimum of about 38 microseconds;

an average of about 58 microseconds; and a maximum of about 134 microseconds.

4. The method of claim 1 further comprising the steps of gold plating said header.

5. The method of claim 2 further comprising the step of milling said LS to about 30 hr mil, whereby said particle size is reduced, improving said flow.

6. The method of claim 1 wherein said miniature piston actuator is an electro-explosive device (EED) comprising part of an electronic thermal battery initiator (ETBI) to provide a mechanical output to initiate a thermal battery.

* * * * *